US006685375B1

(12) United States Patent
Crocker

(10) Patent No.: US 6,685,375 B1
(45) Date of Patent: Feb. 3, 2004

(54) TOOTHPASTE-DISPENSING TOOTHBRUSH

(76) Inventor: John Crocker, 140 Orchard St., Sommerville, MA (US) 02144

( * ) Notice: Subject to any disclaimer, the term of this patent is extended or adjusted under 35 U.S.C. 154(b) by 0 days.

(21) Appl. No.: 10/234,953

(22) Filed: Sep. 4, 2002

(51) Int. Cl.[7] ..... B43K 5/06
(52) U.S. Cl. ..... 401/176; 401/179; 401/270
(58) Field of Search ..... 401/146, 150, 401/151, 171, 176–179, 182, 270, 282, 285, 286

(56) References Cited

U.S. PATENT DOCUMENTS 3,417,762 A * 12/1968 Hall ..... 401/176
5,909,977 A * 6/1999 Kuo ..... 401/171
6,213,663 B1 * 4/2001 Micaletti et al. ..... 401/176
6,220,772 B1 * 4/2001 Taylor ..... 401/176

FOREIGN PATENT DOCUMENTS

GB 2175798 A * 12/1986 ..... A46B/11/02

* cited by examiner

*Primary Examiner*—Tuan N. Nguyen

(57) ABSTRACT

A replaceable toothpaste-dispensing toothbrush is a device designed to combine a toothbrush head with a housing for toothpaste. This combination includes a mechanism for passing g the toothpaste from the housing to the bristles on the toothbrush. The user is thus enabled to easily transport all elements of teeth cleaning. A circular spring-loaded snapping mechanism for mounting disposable brush heads. Also incorporated is a toothpaste injector that seals in the unused toothpaste. Finally a cartridge loading, piston driven dispensing mechanism is introduced in the present invention.

12 Claims, 6 Drawing Sheets

TOOTHPASTE-DISPENSING TOOTHBRUSH

BACKGROUND OF THE INVENTION

1. Field of the Invention

The present invention relates to devices comprising bristles for scrubbing teeth using toothpaste. The toothpaste is stored within the device and can be applied to said bristles by an internal mechanism.

2. Description of the Prior Art

The daily hygiene routine for teeth is to apply toothpaste to the surface of bristles on the head of a toothbrush and to move the brush in a back and forth motion to remove plaque and debris from the surface of the teeth. Commonly the toothpaste is stored in a tube separate from the toothbrush and is applied externally by squeezing the toothpaste onto the bristles attached to a plastic handle. This arrangement requires the storage of a toothpaste tube as well as a toothbrush. Also the tube itself poses various problems. Tubes often leak toothpaste that can be messy. In addition, the excess part of the tube can be cumbersome as it becomes empty. There are alternate designs that use pumps. These designs can also be messy and use an excess of packaging material that increases cost and waste.

The awkwardness of carrying both a tube and a brush can be very inconvenient during transportation. It is a common recommendation of the dental profession to brush one's teeth after every meal. Since most people eat at least one meal a day away from the home, it would be very desirable to have a compact and clean device that the user could transport to brush their teeth. It would also be desirable in such a device to apply the toothpaste as easily as possible.

The devices that exist in the prior art for combining toothpaste storage with brushing devices consist of various deficiencies that do not exist in the present invention. All of them use different mechanisms for the dispensing of toothpaste that are not as efficient as the present invention. They require more parts and will not be as effective. The outlet design of the present invention is unique and greatly reduces the risk of clogging. In addition the detachable toothbrush design of the present invention departs from the prior art and is an improvement in ease and reliability.

U.S. Pat. No. 2,717,101 to Ambrose V. Handel is a device for storing toothpaste and applying the toothpaste to the bristles of an included brush. This design is different from and less efficient then the present invention. The brush head is mounted to the device by a screw-in mechanism. This is a great deal more cumbersome then the snap design of the replaceable toothpaste-dispensing toothbrush. There is also the risk of the threads becoming stripped, rendering the device ineffective. The toothpaste is excreted through a hole in the brush base. This design is shared with all of the inventions in the prior art and has some important inherent flaws. Toothpaste becomes hard when it dries. This drying will occur when the paste is exposed to air and causes a blockage in flow. The present invention includes a novel design feature that encloses the unused toothpaste so that it will not harden due to exposure to the air. The device uses a replaceable cartridge design similar to the present invention but the mechanism for dispensing the toothpaste is significantly different. The Handel '101 design uses a sliding applicator that includes a knife that cuts through the casing of the cartridge while the toothpaste is forced out by the applicator. This design is problematic since the toothpaste is exposed to the device and can create build up of toothpaste on the inner components. Also the device will become difficult to use as the knife dulls.

U.S. Pat. No. 4,826,341 to Kyu Ho Kwak discloses a combination mechanism, but like the Handel '101 design the Kwak '341 design includes a dispensing mechanism that is different then the present invention. The mechanism of Kwak '341 is a sliding applicator that is curved to apply force to a tube inserted within the device thus squeezing toothpaste from the tube. The tube comprises a spout that feeds the toothpaste into a pipe that in turn excretes the toothpaste onto the bristles of a brush head. This device will require greater force then the present invention and can become caught easily if the tube develops wrinkles. Another drawback is that the Kwak '341 design does not disclose a replaceable head for the brush portion. This is a serious drawback since the use of a single brush should be ended when the bristles become soft and frayed. Without a removable design the entire device would have to be replaced every time the bristles wear out.

The device disclosed in U.S. Pat. No. 4,950,095 to Pierre E. Picard uses a dispenser applicator that applies pressure to the cartridge by a disc that rotates a threaded rod that in turn forces a disc into the cartridge. This system for dispensing requires several more parts then the present invention and a more complicated combination that can easily be jammed and broken. In addition this will be more costly to produce. The mounting of the brush head varies greatly from the present invention. It slides into a groove where the head enters an internal chamber and the paste exits a hole adjacent to the brushes. The head is then slid back out for brushing. There are several drawbacks to this design the Paste will clog up the chamber where the brush is inserted and the groove will wear due to frictional use.

U.S. Pat. No. 6,213,663 to John Micaletti et al. is a design for a unit that has two major differences from the present invention. The brush face is detachable on the Micaletti '663 patent as opposed to the brush head. The problem with this design is that it incorporates a permanent passageway between the cartridge and the brush face that can become clogged over time. In addition this would become unsanitary after repeated use since a permanent fixture would be in constant contact with the users mouth. The loading system differs from the present invention. The cartridge in the Micaletti '663 patent is side loaded into a separate column whereas the present invention uses a rear loading design and a single column that would be less expensive to produce.

U.S. Pat. No. 6,145,152 to Peter Martin Ward describes a spring-loaded mechanism for a replaceable brush head. The latching design is distinct from that of the present invention since it uses a lateral spring to activate a lock down released by the press of a button. The lock down binds the brush head to the main body. The present invention however use a circular spring that is attached to the replaceable head and that is activated by squeezing two buttons to alter the angle of two hooks. Squeezed thusly these hooks will engage a ridge on the end of the main body.

U.S. Pat. No. Des. 375,407 to Harold J. Smith discloses a unit that has a brush head mounted by a screw mechanism like the one described in Handel '101. In addition the dispensing mechanism relies on a soft side incorporated in the housing that would be squeezed to force the toothpaste from the inserted tube. This would not eliminate the problems faced with the common tube because the tube could not be squeezed thoroughly and the user will be required to use greater force as the tube becomes less full. In addition this soft-sided material will harden and crack.

Therefore a need exists for a novel and enhanced method for combining a toothbrush and a toothpaste storage device so that the toothpaste can be dispensed directly from the storage device to the toothbrush head. This device should be reusable and durable. It should also be easy to keep clean. In this respect, the replaceable toothpaste dispensing toothbrush according to the present invention substantially departs from the conventional concepts and designs of the prior art, and in doing so provides an apparatus primarily developed for the purpose of combining tooth brushes with toothpaste storage and dispensing devices.

SUMMARY OF THE INVENTION

In view of the foregoing disadvantages inherent in the known types of mobile dental hygiene devices now present in the prior art, the present invention provides an improved combination of convenience and utility, and overcomes the abovementioned disadvantages and drawbacks of the prior art. As such, the general purpose of the present invention, which will be described subsequently in greater detail, is to provide a new and improved replaceable toothpaste dispensing toothbrush which has all of the advantages of the prior art mentioned heretofore and many novel features that result in a toothpaste dispensing toothbrush which is not anticipated, rendered obvious, suggested, or even implied by the prior art, either alone or in combination thereof.

In furtherance of this objective, the toothpaste dispensing toothbrush comprises a toothbrush head wherein said toothbrush head comprises a hole connected to a pipe that passes to the base of said toothbrush head. The base of said toothbrush head further comprises a hollow brush platform that comprises a plurality of holes passing through the walls of said platform. A circular spring is mounted in the center of said platform and attached to the perimeter of said spring is a plurality of hooks comprising a head and a button. Said button passes through said holes in said walls of said platform. The head of said hooks protrude beyond an opening in said platform. The toothpaste-dispensing toothbrush also comprises a reusable toothpaste dispenser that comprises an opening wherein said opening comprises a lip shaped to receive said head of said hooks.

There has been outlined, rather broadly, the more important features of the invention in order that the detailed description thereof that follows may be better understood and in order that the present contribution to the art may be better appreciated.

The present invention may in addition comprise a toothpaste injector that consists of a pair of rubber flaps that form a slit and are mounted on a base that comprises a hole. Connecting said hole in said base is a pipe. Said pipe connects said injector to said hole in said brush head.

An additional aspect of the toothpaste-dispensing toothbrush is the design of a toothpaste dispensing mechanism that comprises a toothpaste dispenser housing. This housing comprises a chute in which may be inserted a cartridge containing paste. The bottom of said cartridge comprises a detachable disk. The wall of said toothpaste dispenser housing comprises a slit through which passes a rib attached to a manually activated pad. Said rib is attached to a L-shaped beam that passes through the center of said chute and is connected to a disc that acts as a piston that presses said disc at the bottom of the cartridge. Said cartridge disc then presses the toothpaste out of the cartridge through a spout located opposite of said bottom.

In order to hold said cartridge in place said toothpaste-dispensing housing further comprises a partition. Said partition comprises a cone shape with a hole at the apex. Said spout of said cartridge passes through said hole in said partition.

To allow access to said dispensing housing for inserting new cartridges, said housing further comprises a second opening connected to said chute. Attached to said housing adjacent to said second opening is a cover that is in turn attached by a hinge and a detachable snap mechanism.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved replaceable toothpaste-dispensing toothbrush that has all of the advantages of the prior art and none of the disadvantages.

It is another object of the present invention to provide a new and improved replaceable toothpaste-dispensing toothbrush that may be easily and efficiently manufactured and marketed.

An even further object of the present invention is to provide a new and improved replaceable toothpaste dispensing toothbrush that has a low cost of manufacture with regard to both materials and labor, and which accordingly is then susceptible of low prices of sale to the consuming public, thereby making such replaceable toothpaste dispensing toothbrushes economically available to the buying public.

Still another object of the present invention is to provide a new replaceable toothpaste dispensing toothbrush that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
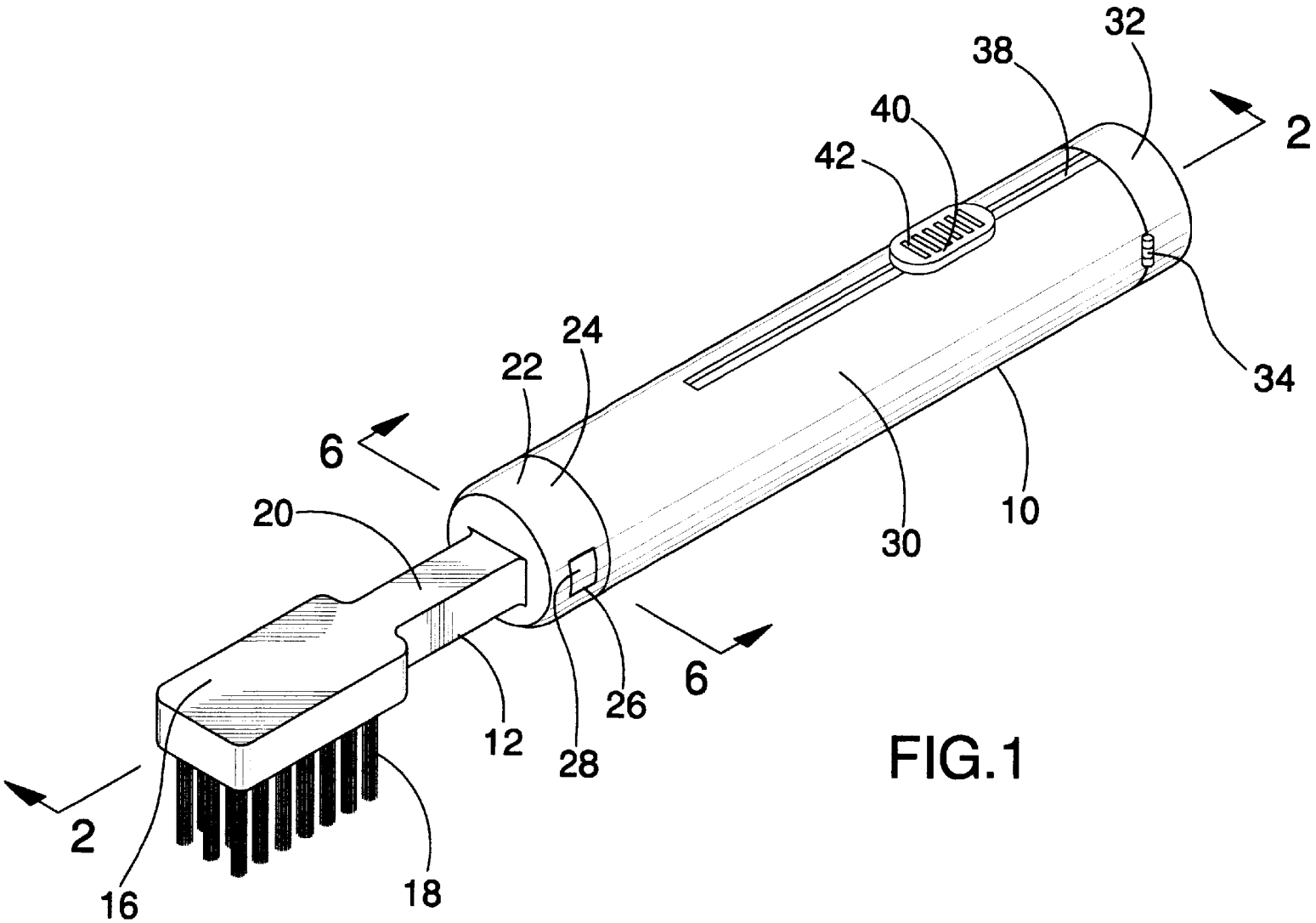
FIG. 1 is a top perspective view of the preferred embodiment of the replaceable toothpaste-dispensirig toothbrush of the present invention.

Referring now to the drawings, and particularly to FIGS. 1–6, a preferred embodiment of the flashlight sleeve of the present invention is shown and generally designated by the reference numeral 10.

In FIG. 1, a top perspective view of a new and improved replaceable toothpaste-dispensing toothbrush 10 of the present invention for mobile dental hygiene is illustrated and will be described. Shown is a replaceable toothbrush mount 12. Said mount 12 comprises a rectangular brush head 16. Said brush head comprises a face where are attached a plurality of bristles 18. Said bristles 18 are arranged in circular bunches to optimize the cleaning utility of said bristles. Said replaceable toothbrush mount 12 further comprises a brush neck 20 attached to said rectangular brush head 16. A cylindrical brush platform 22 is in turn attached to said brush neck 20. Said platform 22 comprises a circular wall 24 that comprises a pair of holes 26 located directly across from one another. Said holes 26 are square and receive square buttons 28. Said holes 26 and buttons 28 can instead be circular or ovate. Said mount 12 would be made of plastic produced in an industrial mold process. Said bristles 18 might be made of a softer plastic that will allow said bristles to flex during the brushing process and conform to the shaped of the user's teeth.

In FIG. 1, a cylindrical toothpaste housing 30 is also shown. In the preferred embodiment of the present invention said housing 30 comprises a first and a second end. Said first end is demountably attached to said cylindrical brush platform 22. Attached to said second end is a cover 32. Said cover 32 is attached on one side by a hinge 34 and on the other side by a snap. The wall of said housing 30 comprises a slit 38 that extends from said second end to a midpoint. A thumb activated dispenser pad 40 is also shown in FIG. 1. Said pad 40 comprises a base 42 and a rib 44. Said rib 44 passes through said slit 38 and said base 42 rests on the surface of said housing 30. Said base comprises a plurality of ridges to increase the friction between said pad and the user's thumb. When the user applies force said pad 40 slides along said slit 38 in the direction of said force. Said housing 30 may be made of plastic produced in an industrial mold process. Said pad 40 may comprise plastic or a combination of plastic and rubber.

Figure 2:
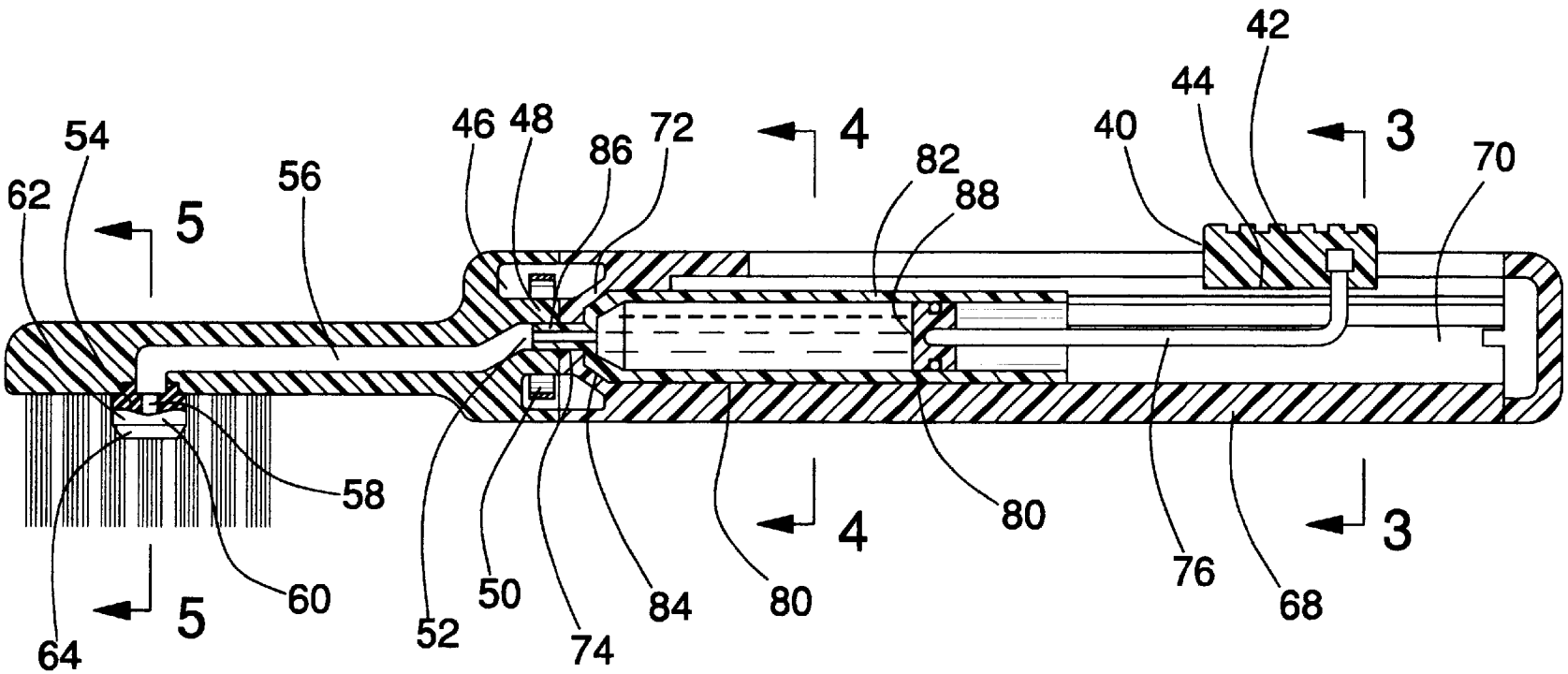
FIG. 2 is a side sectional view of the replaceable toothpaste-dispensing toothbrush of the present invention.

In FIG. 2 is a sectional view of the replaceable toothpaste-dispensing toothbrush 10 from the side. Said replaceable toothbrush mount 12 comprises a cylindrical brush platform 22. Said platform in turn comprises a cavity 46 at its bottom. At the center of said platform 22 and extending within said cavity 46 is a cylindrical spring mount 48. Attached to the circumference of said cylindrical spring mount 48 is a circular spring 50. Said cylindrical spring mount 48 comprises a hole 52 at its bottom. Attached to said platform 22 is a brush neck 20 that is in turn attached to a rectangular brush head 16. The face of said brush head 16 comprises a hole 54. Connecting said hole in said face to said hole in said cylindrical spring mount is a tubular passage 56. Connected to said hole 54 in said face is an outlet pipe 58. Said toothbrush mount 14 further comprises a toothpaste injector 60 that comprises a base 62 and a pair of flaps 64. Said base 62 comprises a hole 66 which is connected to the opposite end of said outlet pipe 58. Said injector would be molded from rubber so that said flap would have the appropriate flexibility combined with resiliency.

Also shown in the sectional side view of FIG. 2 is said cylindrical toothpaste housing 30. Said housing 30 comprises an outer wall 68, a first end, a second end, and a chute 70 connecting said first end to said second end. Said housing also comprises a partition 72 attached to the inner surface of said outer wall 68. Said partition 72 is cone shaped and comprises a hole 74 at its apex. Said hole 76 lines up with said hole 52 in said cylindrical spring mount 46 when said mount is connected to said housing 30. Said outer wall 68 comprises a slit through which passes said rib 44 on said dispenser pad 40. Attached to said pad 40 is an L-shaped beam 76 that extends within said chute 70. Attached to the other end of said L-shaped beam is a disc 78. Attached to said second end is a cover 32. When said second end is open a toothpaste cartridge 80 may be inserted into said chute 70.

In FIG. 2 said cylindrical toothpaste cartridge 80 is illustrated installed within said chute 70 of said housing 30. Said cartridge 80 comprises a cylindrical case 82 with a cone shaped top 84 that is attached to a spout 86 at its apex. Said spout 86 is cylindrical and inserts through said hole 74 in said partition 72. The bottom of said cartridge 80 comprises a detachable disc 88. Said disc 88 will detach when submitted to pressure by said disc 80 attached to said L-shaped beam 76. A sealant such as wax or paraffin would be a possible bonding agent for mounting said disc to said cartridge.

Figure 3:
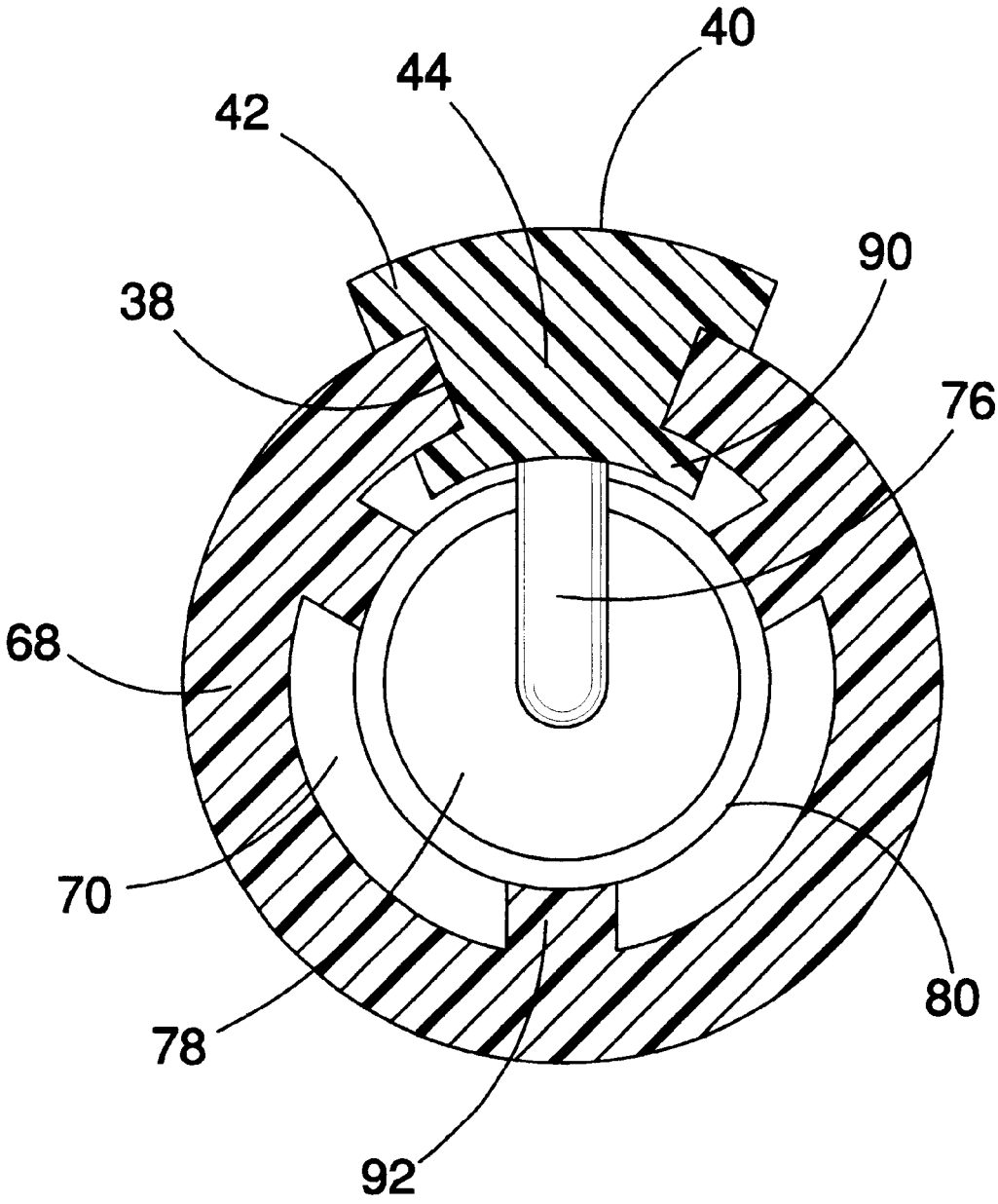
FIG. 3 is a bottom sectional view of the replaceable toothpaste-dispensing toothbrush of the present invention.

In FIG. 3 a sectional view of the cylindrical toothpaste housing 30 is shown. The circular cross section of said outer wall 68 is shown with an opening where said slit 38 is located. Passing through said slit 38 is said rib 44 of said thumb activated dispensing pad 40. Attached to said rib on the exterior of said housing 30 is said base 42 upon which the user applies pressure when dispensing. Attached to said rib 44 on the inside of said housing 30 is a brace 90 that extends beyond the edges of said slit 38 so that said dispensing pad 40 will remain flush against said outer wall 68 of said housing 30. Attached to said dispensing pad 40 is an L-shaped beam 76. Shown is the bottom of said beam 76 which projects from said pad 40 to the middle of said chute 70. The upper branch of said L-shaped beam 76 extends up the middle of said chute 70 where it attaches to said dispensing disc 78. Said beam and said disc may be made of plastic or an inexpensive metal. Attached to the inner side of said outer wall 68 are three brackets 92. Said brackets 92 are rectangular and extend along said chute 70. The inner surface of said brackets 92 are curved and lie along a circle having a diameter that matched the outer diameter of said cylindrical cartridge 80. Said Cartridge 80 is slid within said brackets 92 and held in place. Said cartridge 80 could be made of a variety of lightweight, easily moldable and inexpensive materials. Some examples might be plastic, foil, or wax lined cardboard.

Figure 4:
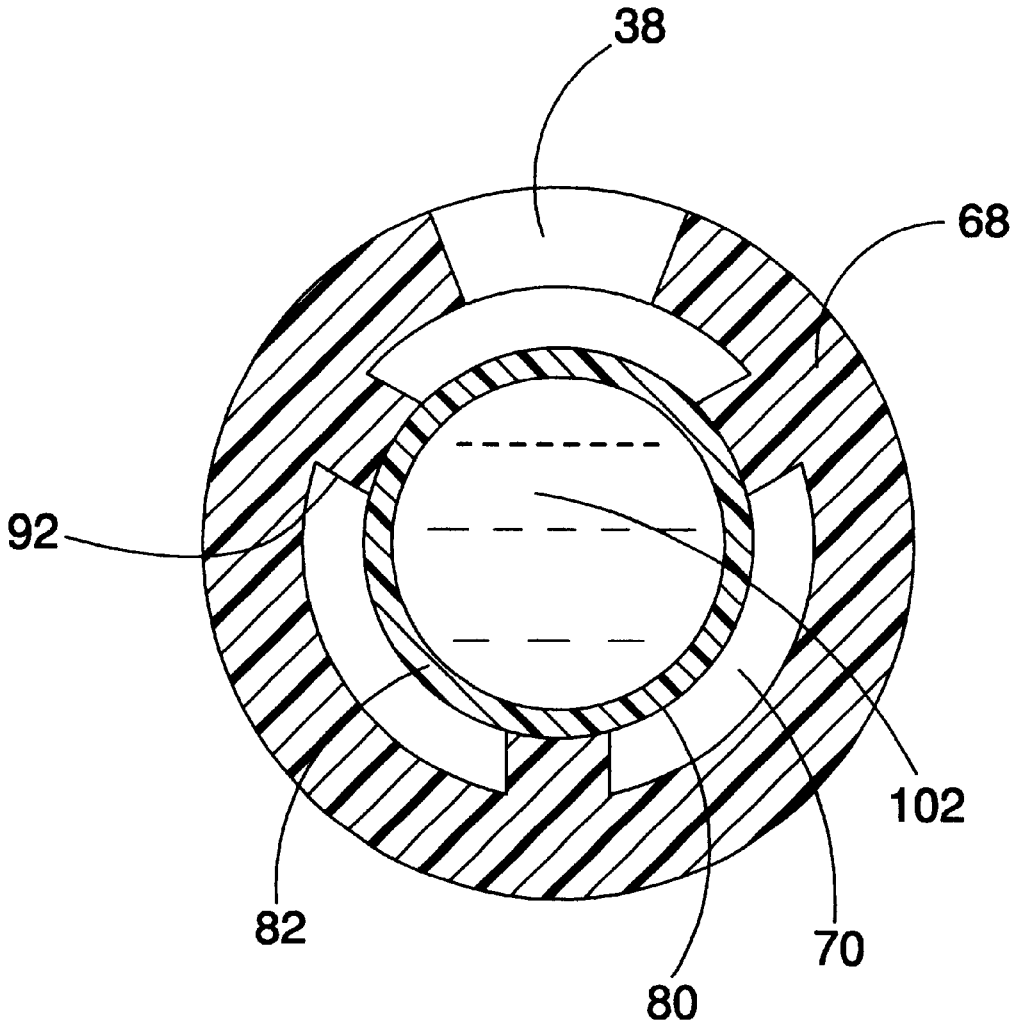
FIG. 4 is a midpoint sectional view of the replaceable toothpaste-dispensing toothbrush of the present invention.

FIG. 4 is a sectional view of said cylindrical toothpaste housing 30 at a midpoint beyond said thumb activated dispensing pad 40. Again is shown said outer wall 68 of said housing 30 and said slit 38 that it comprises. Said brackets 92 are pictured and comprise a curved inner surface for receiving said cartridge 80. Said cartridge 80 is shown as a cross section of its case 82 and illustrated within is said toothpaste.

Figure 5:
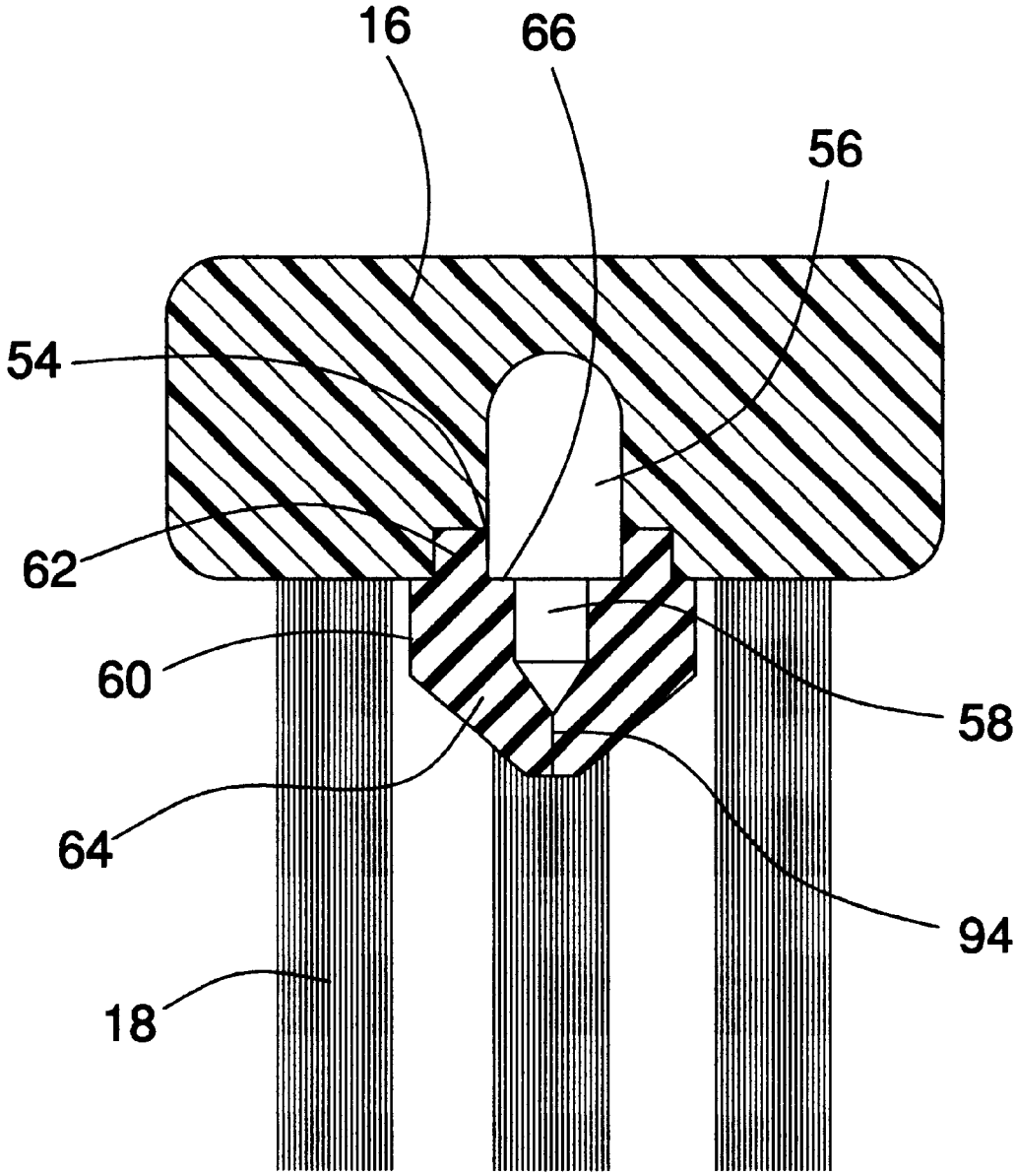
FIG. 5 is a midpoint sectional view of the replaceable toothpaste-dispensing toothbrush of the present invention.

FIG. 5 is a sectional view of the uniquely designed toothpaste dispensing mechanism of the present invention. Incorporated in this design is a pair of rubber flaps 64. Said flaps 64 are connected to a base 66 and extend together to form a slit 94. Said flaps 64 are made of a stiff material with some flexibility such as rubber. When said toothpaste is pressed forward by said thumb activated pad 40, said flaps 64 are forced apart and said toothpaste will be injected among said bristles 18 on said surface of said brush head 16. When the force is no longer applied, said flaps 64 reseal to maintain said toothpaste unexposed to the air. Said base 62 comprises a hole 66 through which passes an outlet pipe 58. Said pipe 58 is attached to said passage 56 in said replaceable toothbrush mount 12 and through which the toothpaste is transported.

Figure 6:
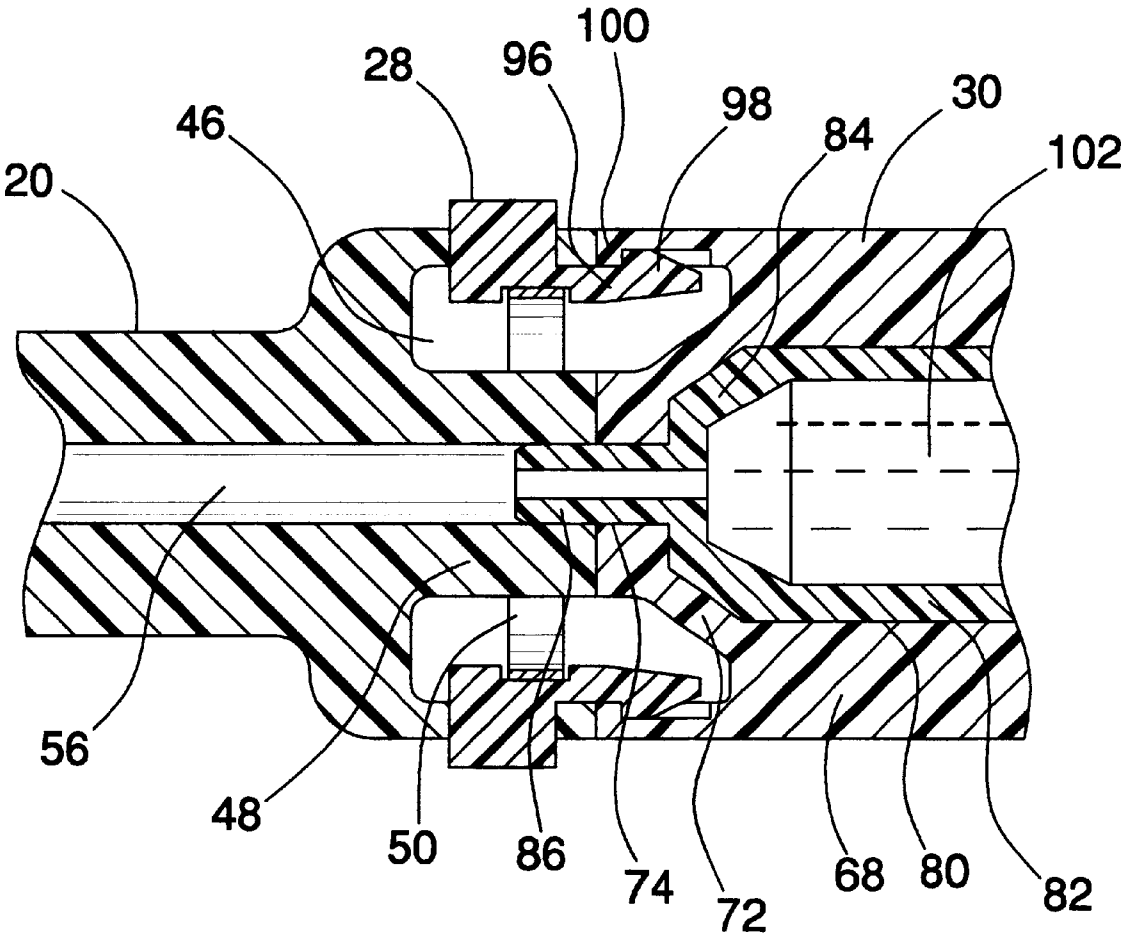
FIG. 6 is a side sectional view of the detachable mounting mechanism of the replaceable toothpaste-dispensing toothbrush of the present invention.

In FIG. 6 the unique mounting mechanism of the present invention is illustrated. The replaceable toothbrush mount 12 comprises a cylindrical brush platform 22. Said platform 22 comprises an outer wall 24 that further comprises a pair of square holes 28. Said platform also comprises an inner cylindrical spring mount 48 attached to its center. Between said wall 24 of said platform 22 and said spring mount 48 is a cavity 46. Around the circumference of said cylindrical spring mount 48 is a circular spring 50 made of metal that will flex when pressure is applied. Attached to the outer surface of said circular spring 50 is a pair of hooks 96. Said hooks 96 comprise a head 98 that further comprises a rectangular button 28. Said button 28 passes through said hole 26 in said wall 24 of said brush platform 22. The first end of said cylindrical toothpaste housing 30 comprises a circular edge that further comprises a lip 100. When said brush platform 22 of said replaceable toothbrush mount 12 is pressed against said housing 30, the slanted edge of said hooks 96 will be pressed inward and said circular spring 50 will allow said hooks 96 to pass said lip 100 of said first end of said housing 30. After said hook 96 passes said lip 100, said hook will snap back in place and prevent said replaceable toothbrush mount 12 from detaching. When the user desires to release said mount 12 then the user presses said buttons 28. The force will contract said circular spring 50 and force said hooks 96 inwards so that the hooks can pass beyond said lip 100 and said mount 12 can be removed.

Said cylindrical spring mount comprises a hole 52 that is connected to said passage 56 in said replaceable toothbrush mount 12. Inserted into said hole 52 in said spring mount 48 is said spout 86 of said cartridge 80. Said spout 86 of said cartridge 80 also passes through said hole 74 at the apex of said cone-shaped partition 72. Said cartridge 80 comprises a chamber 102 inside which is held said toothpaste. Said cartridge 80 is inserted inside said chute 70 of said toothpaste dispensing housing 30 where it rests against said partition 72.

While a preferred embodiment of the replaceable toothpaste-dispensing toothbrush 10 has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention. For example, any suitable flexible material may be used instead of the fabrics that have been described. And although the attaching of flashlights has been described, there are slight variations, such as shape and size that would make the invention appropriate for other light sources or other similar devices.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste-dispensing toothbrush comprising:

a replaceable toothbrush mount comprising a cylindrical brush platform wherein said cylindrical brush platform comprises a plurality of holes, a cavity and a cylindrical spring mount and wherein said cylindrical spring mount further comprises a hole;

a circular spring attached to said cylindrical spring mount;

a plurality of hooks attached to said circular spring wherein said hooks comprise a base and a head and wherein said base passes through said hole in said cylindrical brush platform;

a toothpaste housing comprising a chute, an outer wall, a first and a second opening wherein the edge of said first opening comprises a lip and where in said lip is demountably engaged with said head of said hooks.

2. The toothbrush of claim 1 wherein said toothbrush mount further comprises a rectangular brush head attached to a neck and wherein said neck is attached to said cylindrical brush platform and wherein said rectangular brush head further defines a hole therein.

3. The toothbrush of claim 1 wherein said toothbrush mount further comprises a passage connecting said hole in said cylindrical spring mount to said hole in said brush head.

4. The toothbrush of claim 1 wherein said outer wall of toothpaste housing defines a slit therein.

5. The toothbrush of claim 1 wherein said housing further comprises a partition attached to said outer wall and dividing said chute wherein said partition defines a hole therein.

6. The toothbrush of claim 1 wherein said toothpaste housing further comprises a cover wherein said cover comprises a hinge and a latch and wherein said hinge is attached to said second end of said housing and wherein said latch is demountably attached to said second end of said housing.

7. The toothbrush of claim 1 further comprising a toothpaste case comprising a chamber, a detachable circular base, and a spout wherein said spout is connected to said hole in said brush head and said toothpaste case rests within said chute of said toothpaste housing.

8. A replaceable toothpaste dispensing toothbrush comprising:

a toothpaste housing comprising a chute, an outer wall, a first opening with a lip, a second opening and wherein said outer wall comprises a slit;

a thumb activated pad comprising a platform and a rib wherein said rib passes through said slit in said outer wall of said toothpaste housing;

an L-shaped arm attached to said thumb-activated pad wherein a portion of said arm projects on the axis of said chute;

a disc attached to said L-shaped arm;

a partition attached to said outer wall and dividing said chute and wherein said partition comprises a hole;

a cylindrical toothpaste case comprising a chamber, a detachable circular base, and a spout wherein said spout passes through said hole in said partition and said toothpaste case rests within said chute of said toothpaste housing;

a replaceable toothbrush mount demountably attached to said first opening of said toothpaste housing;

a circular spring attached to a cylindrical spring mount of a cylindrical brush platform of said toothbrush mount; and a plurality of hooks attached to said circular spring, wherein said hooks comprise a base and a head, wherein said base passes through a hole in said cylindrical brush platform, and wherein said lip is demountably engaged with said head.

9. The toothbrush of claim 8 wherein said replaceable toothbrush mount further comprises a rectangular brush head attached to a neck and wherein said neck is attached to a cylindrical brush platform and wherein said rectangular brush head further defines a hole therein.

10. The toothbrush of claim 8 wherein said toothpaste housing further comprises a cover wherein said cover comprises a hinge and a latch and wherein said hinge is attached to said housing and wherein said latch is demountably attached to said housing.

11. The toothbrush of claim 8 further comprising a toothpaste case comprising a chamber, a detachable circular base, and a spout wherein said spout is connected to said replaceable toothbrush mount demountably attached to said first opening of said toothpaste housing.

12. The toothbrush of claim 8 wherein said replaceable toothbrush mount comprises a toothpaste injector head comprising a base and a pair of flaps, said flaps defining a slit therebetween, and wherein said injector head defines a chute passing from said slit to said base.

* * * * *